US006039229A

United States Patent [19]

Pfister et al.

[11] Patent Number: 6,039,229

[45] Date of Patent: Mar. 21, 2000

[54] SETTING TOOL

[75] Inventors: Norbert Pfister, Montlingen; Mario Grazioli, Chur, both of Switzerland; Gerhard Ehmig, Rankweil, Austria

[73] Assignee: Hilti Aktiengesellschaft, Schaan, Liechtenstein

[21] Appl. No.: 09/248,808

[22] Filed: Feb. 11, 1999

[30] Foreign Application Priority Data

Feb. 11, 1998 [DE] Germany ..... 198 05 442

[51] Int. Cl.[7] ..... B25C 1/14

[52] U.S. Cl. ..... 227/10

[58] Field of Search ..... 227/9, 10, 11, 227/130; 173/210, 212

[56] References Cited

U.S. PATENT DOCUMENTS 4,074,843 2/1978 Oesterle ..... 227/10

4,374,567 2/1983 Combette et al. ..... 227/9

5,048,740 9/1991 Beton ..... 227/10

5,213,247 5/1993 Gschwend et al. ..... 227/10

5,332,140 7/1994 Almeras et al. ..... 227/9

*Primary Examiner*—Scott A. Smith

*Attorney, Agent, or Firm*—Brown & Wood, LLP

[57] ABSTRACT

A high-pressure gas-operated setting tool for driving nail-shaped fastening elements into hard constructional components and including a slide (73) displaceable in a guide housing (7) under action of a portion of the high-pressure gas, which is used for displacement of the drive piston (6) in the setting direction, against a biasing force of a spring (8) and having a pawl projecting into the axial projection of the drive piston (6), the pawl (78) displacing the drive piston upon the slide (73) being displaced by the spring (8) in a direction opposite to the setting direction.

9 Claims, 5 Drawing Sheets

SETTING TOOL

BACKGROUND OF INVENTION

1. Field of the Invention

The present invention relates to a setting tool for driving nail-shaped fastening elements into hard constructional components and including a guide cylinder, a drive piston axially displaceable in the guide cylinder, a guide housing a slide displaceable in the guide housing and having a pawl cooperating with a stop surface provided on the drive piston and pivotable out of an axial projection of the drive piston against a biasing force applied by a spring member, and an operating cam cooperating with a control profile provided on the pawl.

2. Description of the Prior Art

For driving nail-shaped fastening components into hard constructional components such as concrete, stone, or steel and the like, setting tools, which are operated by high-pressure gases, are used. In widely used and preferred, from the standpoint of safety, setting tools, the high-pressure gases act on a drive piston which, in turn, drives a to-be-driven fastening element into a hard constructional component. While these tools have significant advantages, they also have a serious drawback which consists in that the drive piston should be pushed back in its initial position after each drive-in process.

German Patent no. 2,026,293 discloses an explosive powder charge-operated setting tool in which the drive piston is returned to its initial position after each setting process manually. In this setting tool, a slide is displaced in a guide housing with a handle accessible from outside of the setting tool. A tension spring connects the slide with a front, in a setting direction, region of the guide housing. The slide includes a pawl pivotable into the axial projection of the drive piston by a spring member when the slide is displaceable with the handle in a direction opposite to the setting direction. When the slide is in its initial position, a control profile provided on the pawl cooperates with an operating cam which retains the pawl from projecting into the axial projection of the drive piston.

This type of returning of the drive piston into its initial position is very cumbersome and can be dangerous when simultaneously with the displacement of the slide with the handle in a direction opposite to the setting direction, a new cartridge is ignited.

Accordingly, an object of the present invention is a high-pressure gas-operated setting tool in which the drive piston automatically returns to its initial position after each setting process.

SUMMARY OF THE INVENTION

This and other objects of the present invention, which will become apparent hereinafter, are achieved by providing a setting tool including a guide cylinder, a drive piston axially displaceable in the guide cylinder, a guide housing, and a slide displaceable in the guide housing against a spring-biasing force acting in a direction opposite to a setting direction. The slide has a pawl cooperating with a stop surface provided on the drive piston and pivotable out of an axial projection of the drive piston against a biasing force applied by a spring member. The pawl has a control profile cooperating with an operating cam provided in an end region of the guide cylinder opposite to the setting direction. At least one connection channel connects end regions of the guide housing with the guide cylinder opposite to the setting direction.

In the inventive setting tool, the high-pressure gas drives not only the drive piston in the setting direction but also the slide. The pawl, which is arranged on the slide, has a control profile which cooperates with the operating cam which prevents the pawl from projecting into the axial projection of the drive piston. This insures unhindered displacement of the drive piston, which has a higher acceleration than the slide, in the setting direction by a high-pressure gas.

When the slide is displaced, together with the drive piston, in a setting direction, the control profile of the pawl becomes disengaged from the operating cam, and a spring member, which is arranged between the pawl and the slide, pivots the pawl into the axial projection of the drive piston. The slide reaches its end position at the earliest after the drive piston already reached the end, in the setting direction, region of the guide cylinder or has rebound from the fastening element and has been accelerated toward its initial position by the stored residual power.

Upon its displacement back to its initial position, the drive piston engages the pawl which projects into the axial projection of the drive piston. In order to prevent clinging of the drive piston to the pawl, the pawl is provided with an inclined, in a setting direction, surface that provides for pivoting of the pawl out of the axial projection of the drive piston during the combined displacement of both the drive piston and the slide to their respective initial positions until the drive piston passes past the pawl.

A spring which, e.g., is formed as a compression or scroll spring and is compressed upon displacement of the slide in the setting direction, pushes the slide, after it has reached its end, in the setting direction, position, back to its initial position. The drive piston, which has not yet reached its initial position, has its stop surface engaged by the pawl which pushes the drive piston to its initial position. Shortly before the slide reaches its initial position, the control profile of the pawl engages the operating cam which pivots the pawl completely out of the axial projection of the drive piston.

A time-delayed acceleration of the slide relative to the drive piston is achieved by providing advantageously a connection channel that opens radially into the guide cylinder at a location spaced axially in the setting direction from the bottom of the guide cylinder which faces in the setting direction.

A uniform distribution of the high-pressure gas in the end region of the guide channel, which is formed the guide housing, is preferably achieved by providing a connection channel which opens into the bottom of the guide channel facing in the setting direction. The slide can, e.g., be provided with a distribution chamber formed at the free end of the slide opposite to the setting direction and serving for accommodating the expansion of the high-pressure gas before the acceleration of the slide in the setting direction takes place.

In setting tools in which for setting fastening elements having different length, different propellant gas pressures are needed, advantageously, two connection channels open into the guide housing, with one channel being associated with a vent channel the cross-section of which is varied with an adjusting member. The vent channel extends between the guide cylinder and, the atmosphere. The second channel is spaced axially, in the setting direction, from the vent channel and opens into the guide cylinder. The two connection channels serve for directing a portion of a high-pressure gas into the guide housing where it applies the same pressure to the slide independent of the position of the adjusting member relative to the vent channel or independent of the pressure established in the guide cylinder with the adjusting member. This provides for displacement of the slide in the setting direction with a uniformly accelerated speed.

When, e.g., the entire energy of the high-pressure gas is necessary for the displacement of the drive piston in the guide cylinder, the adjusting member is in its closed position, and the vent channel is closed. With the vent channel being closed, the entire amount of the high-pressure gas necessary for the acceleration of the slide is delivered into the guide housing through the second connection channel. When a smaller pressure is needed in the guide cylinder for displacing the drive piston, at least partial opening of the vent channel is effected by the displacement of the adjusting member in a direction opposite to the setting direction. In this case, the high-pressure gas needed for the displacement of the slide is delivered through the first and second connection channels.

To simplify the manufacturing and to reduce manufacturing costs, advantageously, the adjusting member is displaceable transverse to the longitudinal axis of the vent channel.

In order to provide for a form-locking engagement of the pawl, which is arranged on the slide, with the drive piston when the slide is displaced to its initial position, advantageously, the inner chambers of both the guide cylinder and the guide channel, which is formed in the guide housing, are connected with each other by respective elongate slots extending parallel to the longitudinal axis of the drive piston. Through these slots, the pawl can project into the inner chamber of the guide cylinder, i.e., into the axial projection of the drive piston.

For the sake of simplification of the manufacturing, advantageously, both the guide channel of the guide housing and the slide have a circular cross-section.

To prevent a pivotal movement of the slide in the guide channel, advantageously, the guide housing is provided with a slot extending parallel to the axis of the drive piston, and the slide is provided with a guide member projecting through the slot.

To simplify manufacturing, advantageously the guide member is formed as a bolt.

BRIEF DESCRIPTION OF THE DRAWINGS

The features and objects of the present invention will become more apparent, and the invention itself will be the best understood from the following detailed description of the preferred embodiment when read with reference to the accompanying drawings, wherein.

DESCRIPTION OF THE PREFERRED EMBODIMENTS

Figure 1:
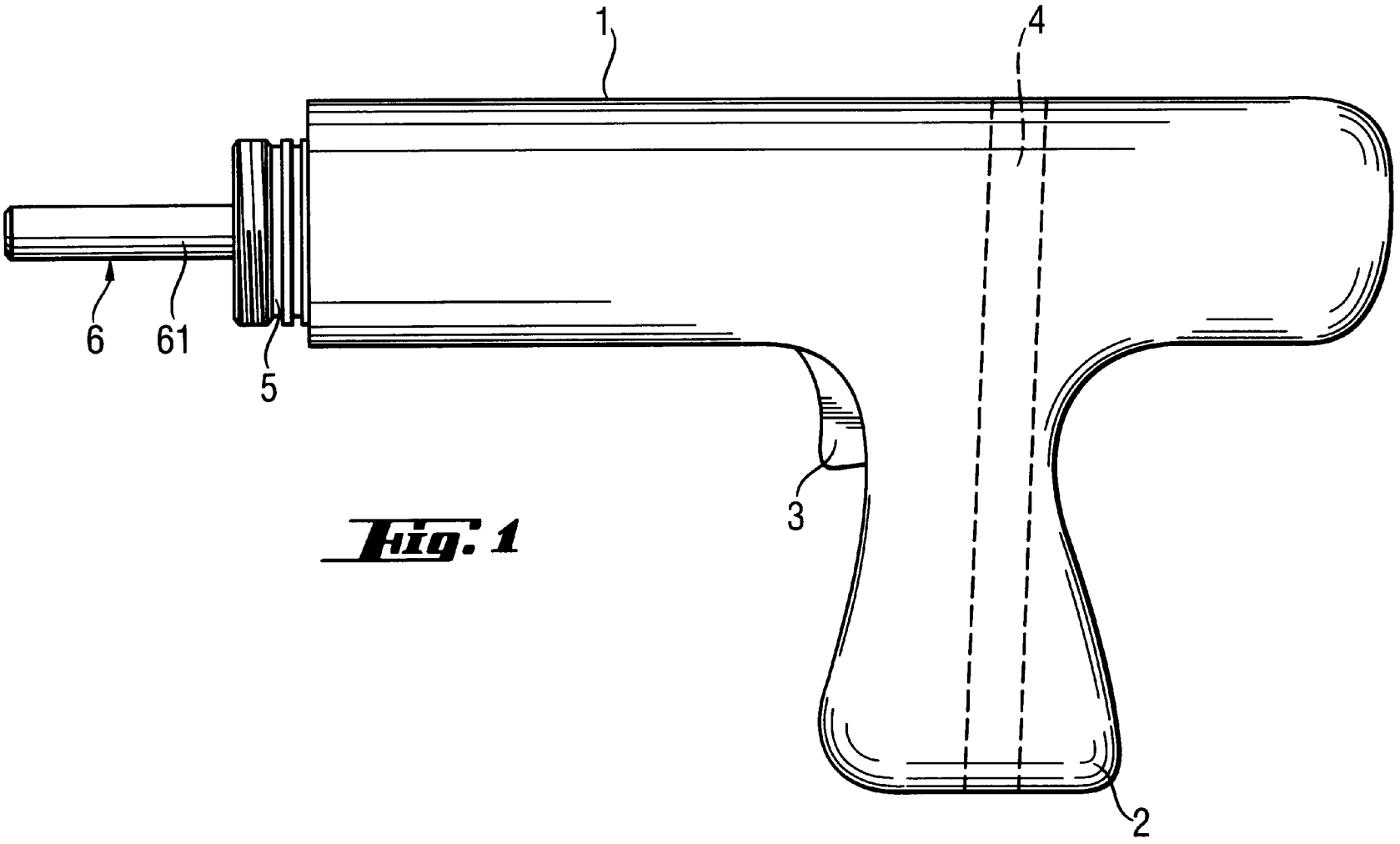
FIG. 1 shows a schematic side elevational view of a setting tool according to the present invention.

A setting tool according to the present invention, which is shown in FIG. 1, is driven with high-pressure gases, e.g., with an explosive powder charge. The setting tool includes a housing 1 and a handle 2, which is formed as one piece with the housing 1. A cartridge channel 4 for receiving a strip-shaped cartridge clip with a plurality of cartridges, not shown, extends through the handle 2. An actuation trigger 3 is provided in the transitional region between the housing 1 and the handle 2. The trigger 3 serves for actuating a firing mechanism not shown. A Guide cylinder 5 and a stem 61 of a drive piston 6 project beyond the end, in a setting direction, region of the housing 1.

Figure 2:
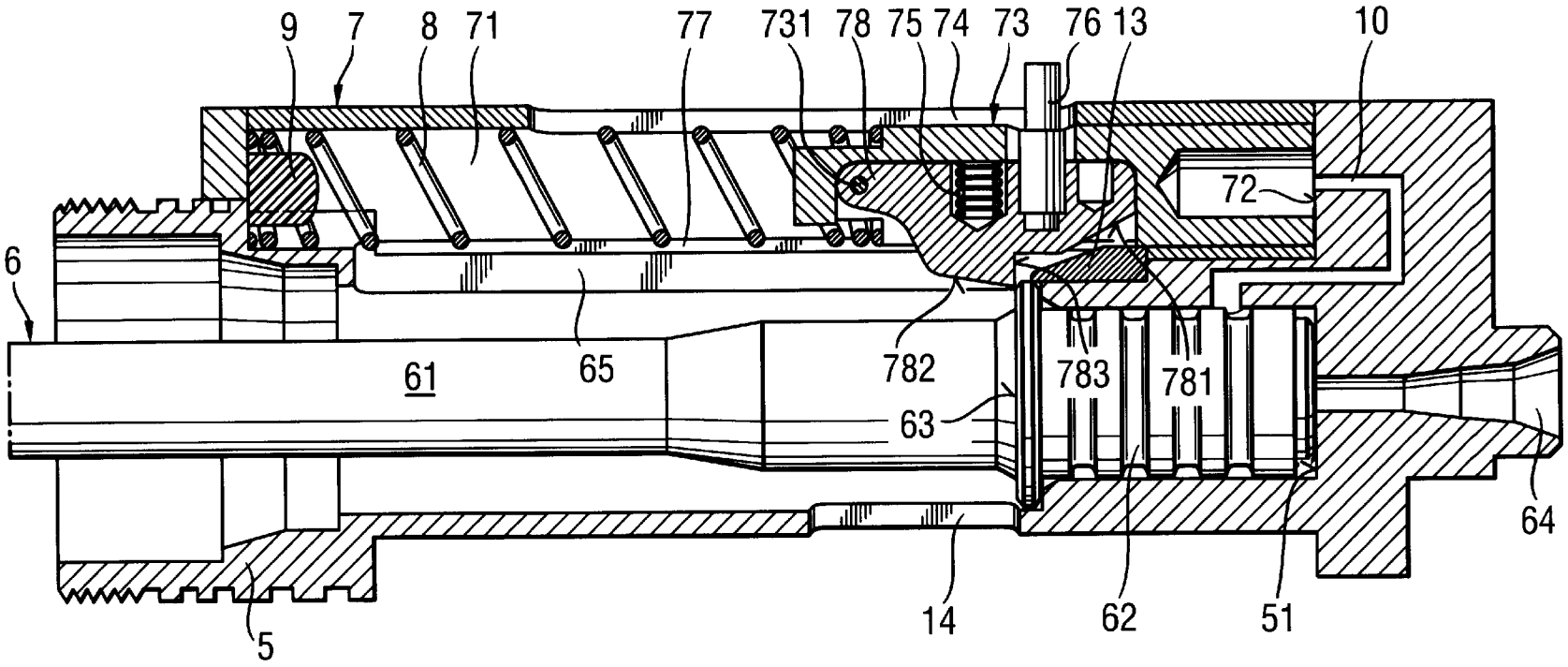
FIG. 2 shows a cross-sectional view of a portion of the setting tool shown in FIG. 1 at an increased scale in the initial position of the tool.
Figure 3:
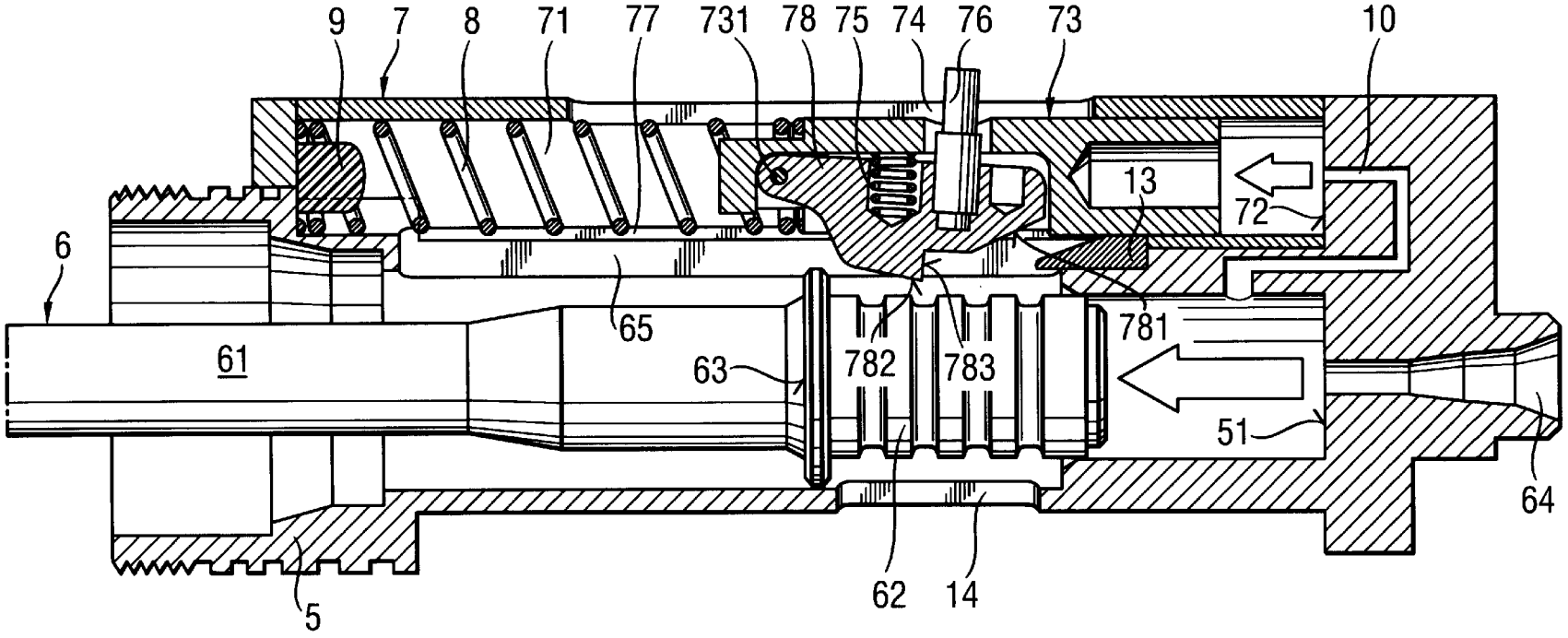
FIG. 3 shows a cross-sectional view of the same portion of the setting tool shown in FIG. 2 in the position of the tool immediately after the beginning of the setting process.
Figure 4:
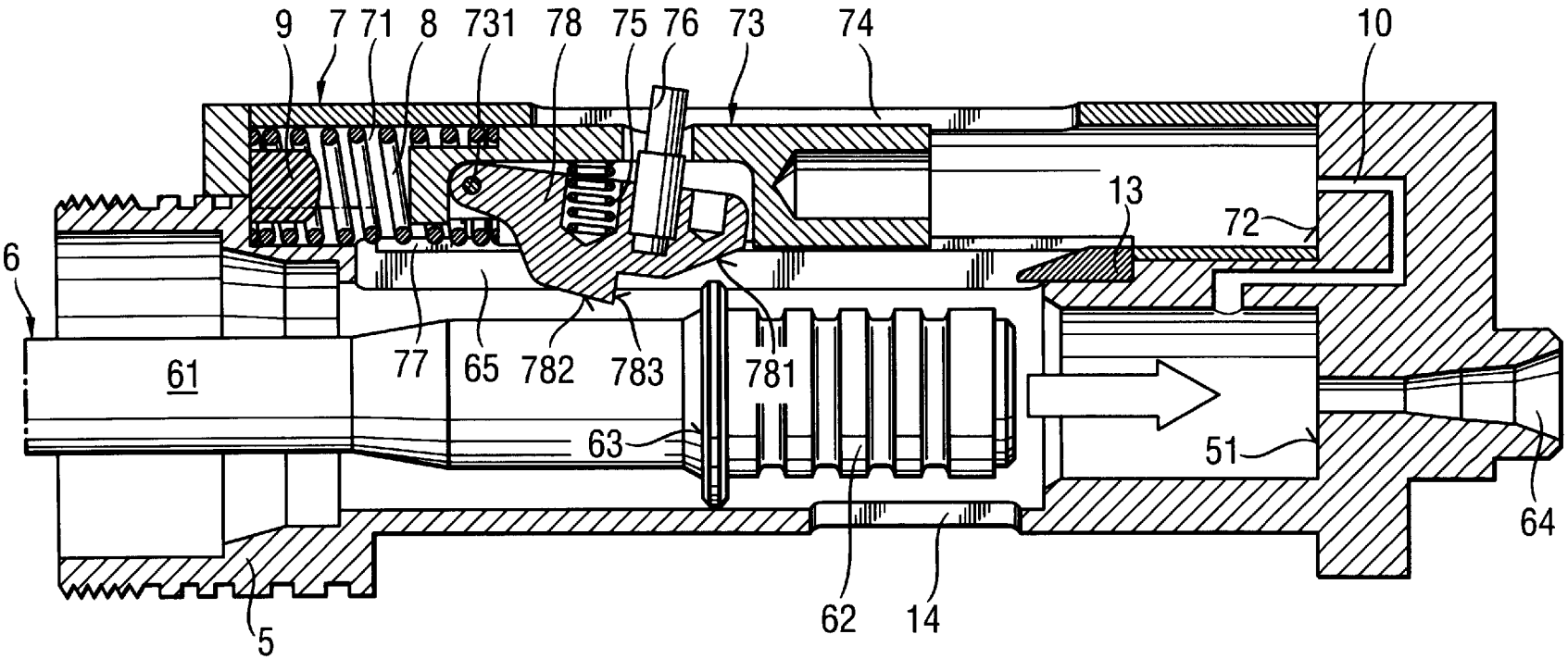
FIG. 4 shows a cross-sectional view of the same portion of the setting tool shown in FIGS. 2 and 3 after the setting process has ended.

The guide cylinder 5, which is shown in detail in FIGS. 2, 3 and 4, is displaceable, in a direction opposite to the setting direction, against a biasing force of a spring, not shown, when the setting tool is pressed against a constructional component, likewise not shown. At its end, opposite to the setting direction, the guide cylinder 5 has a cartridge chamber 64 in which a cartridge, not shown, is received.

The axially displaceable drive piston 6 is located in the inner chamber of the guide cylinder 5. The drive piston 6 is formed of the stem 61 and a head 62 adjoining the stem 61. The head 62 extends radially beyond the stem 61. The cross-sectional surface of the head 62 corresponds substantially to the inner diameter of the guide cylinder 5. The stem 61 has a substantially constant diameter. A stop surface 63, which face in the setting direction, is provided in the transition region between the stem 61 and the head 62. The inner chamber of the guide cylinder 5 has bottom 51 likewise facing in the setting direction. A channel, which is connected with the cartridge chamber 64, opens into the bottom 51. A discharge opening 14, which is formed in the circumference of the guide cylinder 5, serves for flushing the inner chamber of the guide cylinder 5.

A guide housing 7 extends parallel to the guide cylinder 5. The guide housing 7 has a cylindrical guide channel 71 in which a slide 73 is displaced in the setting direction against a biasing force of a spring 8. The slide 73 has a pawl 78 pivotable about a pivot 731 against a biasing force of a spring member 75. The pawl 78 is provided on a side of the slide 73 adjacent to the guide cylinder 5. A surface 782 of the pawl 78, adjacent to the guide cylinder 5, is inclined in the setting direction. The pawl 78 is further provided with a control profile 781 inclined in a direction opposite to the setting direction and a stop surface 783 provided between the surface 782 and the control profile 781.

At a side thereof remote from the guide cylinder 5, the pawl 78 has a blind bore in which at least a portion of the spring member 75 is received. A guide member 76, which is formed as a bolt, projects from the pawl 78 parallel to the axis of the blind bore. The guide member 76 extend through the slide 73 and an elongated slot 74 provided in the guide housing 7. The guide member 76 prevents rotation of the slide 73 in the guide channel 71.

The guide channel 71 has, like the inner chamber of the guide cylinder 5, a bottom 72 facing in the setting direction and aligned with the bottom 51 of the inner chamber of guide cylinder 5. Both the guide cylinder 5 and the guide channel 71 are provided with elongated slots 65 and 77, respectively, extending parallel to the longitudinal axis of the drive piston 6. A control or operating cam 13 is provided in the end region of the slot 65 opposite to the setting direction. The operating cam 13 cooperates with the control profile 781 of the pawl 78 in the initial position of the slide 73.

A connection channel 10 connects the guide channel 71 with the end region of the guide cylinder 5 opposite to the setting direction.

Figure 5:
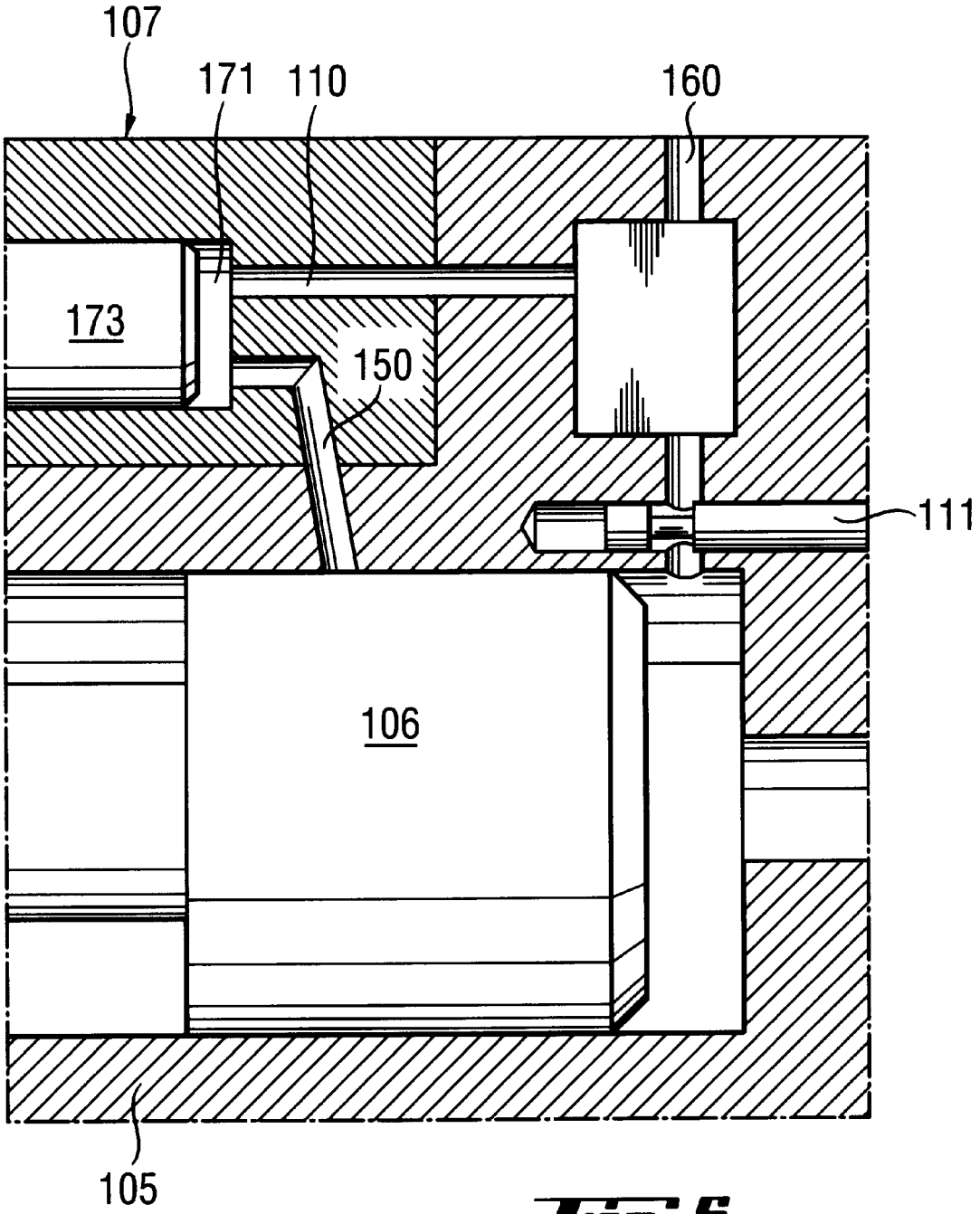
FIG. 5 shows a cross-sectional view of an end region of a guide cylinder remote from the front portion of the tool of another embodiment of a setting tool according to the present invention.

FIG. 5 shows a guide cylinder 105, a drive piston 106, and a guide housing 107 with a guide channel 171 in which a slide 173 is displaced against a biasing force of a spring not shown.

Two connection channels 110 and 150 open into the guide channel 171 of the guide housing 107. The first channel 110 is associated with a vent channel 160 the cross-section of which is varied with an adjusting member 111. The vent channel 160 extend between the guide cylinder 105 and the atmosphere. The second channel 150 is spaced axially, in the setting direction, from the vent channel 160 and opens into the guide cylinder 105. The two connection channels 110 and 150 serve for directing a portion of a high-pressure gas into the guide housing 107 where it applies the same pressure to the slide 173 independent of the position of the adjusting member 111 relative to the vent channel 160 or independent of the pressure established in the guide cylinder with the adjusting member 111. This provides for displacement of the slide 173 in the setting direction with a uniformly accelerated speed.

When, e.g., the entire energy of the high-pressure gas is necessary for the displacement of the drive piston 106 in the guide cylinder 105, the adjusting member 111 is in its closed position, and the vent channel 160 is closed. With the vent channel 160 being closed, the entire amount of the high-pressure gas necessary for the acceleration of the slide 173 is delivered into the guide housing 107 through the connection channel 150. When a smaller pressure is needed in the guide cylinder 105 for displacing the drive piston 106, at least partial opening of the vent channel 160 is effected by the displacement of the adjusting member ill in a direction opposite to the setting direction. In this case, the high-pressure gas needed for the displacement of the slide 173 is delivered through the first connection channel 110, which is connected with the vent channel 160, and through the second connection channel 150. The inner diameters of the channels 160, 150 and 110 and thereby the flow velocity of the high-pressure gas in the channels 160, 150 and 110 are controlled with orifice restrictors provided in the channels 160, 150 and 110.

Now, the course of a setting process with a setting tool according to the present invention will be described with reference to the setting tool shown in FIGS. 1–4.

As discussed above, FIG. 2 shows a setting tool with the drive piston 6 and the slide 73 in their initial positions. The control profile 781 of the pawl 78 cooperates with the operating cam 13. The pawl 78 does not project into the axial projection of the drive piston 6.

Shortly after the ignition of a cartridge, first the drive piston 6 is accelerated and shortly thereafter the slide 73 is accelerated. This position of the drive piston 6 and the slide 73 is shown in FIG. 3. The control profile 781 of the pawl 78 separates from the operating cam 13, and the spring member 75, which is provided between the pawl 78 and the slide 73, pivots the pawl 78 into the axial projection of the drive piston 6.

Because the drive piston 6 has a greater acceleration than the slide 73, the slide 73 reaches its end position at the earliest after the drive piston 6 already reached the end, in the setting direction, region of the guide cylinder 5 or has rebound from the fastening element and has been accelerated toward its initial position by the stored residual power. In the end, in the setting direction, position, the slide 73 rebounds from a damping member 9.

FIG. 4 shows the drive piston 6 in an intermediate position when the drive piston 6 is being displaced back to its initial position. In this intermediate position, the pawl 78 projects into the axial projection of the drive piston 6. In order to prevent clinging of the drive piston 6 to the pawl 78, the pawl 78 has, as it has already been described above, an inclined, in the setting direction, surface 782 which insures pivoting of the pawl 78 out of the axial projection of the drive piston 6 until the drive piston 6 passes past the pawl 78.

The spring 8, which was compressed upon the displacement of the slide 73 in the setting direction, pushes the slide 73 to its initial position. The drive piston 6, which has not yet reached its initial position, has its stop surface 63 engaged by the pawl 78 which pushes the drive piston 6 to its initial position. Shortly before the slide 73 reaches its initial position, the control profile 781 of the paw 78 engages the operating cam 13 which pivots the pawl 78 completely out of the axial projection of the drive piston 6.

Though the present invention was shown and described with references to the preferred embodiments, various modifications thereof will be apparent to those skilled in the art and, therefore, it is not intended that the invention be limited to the disclosed embodiment or details thereof, and departure can be made therefrom within the spirit and scope of the appended claims.

What is claimed is:

1. A setting tool for driving nail-shaped fastening elements into hard constructional components, comprising a guide cylinder (5, 105); a drive piston (6, 106) axially displaceable in the guide cylinder (6, 106); a guide housing (7, 107); a slide (73, 173) displaceable in the guide housing (7, 107) against a spring-biasing force acting in a direction opposite to a setting direction, the slide (73, 173) having a pawl (78) cooperating with a stop surface (63) provided on the drive piston (6, 106) and pivotable out of an axial projection of the drive piston (6, 106) against a biasing force applied by a spring member, the pawl (78) having a control profile (781) cooperating with an operating cam (13) provided in an end region of the guide cylinder (5, 105) opposite to the setting direction; and at least one connection channel (10, 110, 150) connecting end regions of the guide housing (7, 107) and the guide cylinder (5, 105) opposite to the setting direction.

2. A setting tool according to claim 1, wherein the connection channel (10) opens radially into the guide cylinder (5) at a location spaced axially in a setting direction from a (51) of the guide cylinder (5) facing in the setting direction.

3. A setting tool according to claim 1, wherein the connection channel (10) opens into a bottom (72) of the guide housing (7) facing in a setting direction.

4. A setting tool according to claim 1, comprising two connection channels (110, 150) opening into the guide housing (107); a vent channel (160) connected with a first one (110) of the connection channels an extending between the guide cylinder (105) and the atmosphere; an adjusting member (111) for varying a cross-section of the vent channel, the second connection channel (150) being axially spaced in a setting direction from the vent channel (160).

5. A setting tool according to claim 4, wherein the adjusting member (111) is displaced substantially transverse to a longitudinal axis of the vent channel.

6. A setting tool according to claim 1, wherein both an inner chamber of the guide cylinder (5, 105) and a guide channel (71, 171) formed in the guide housing (7, 107) have respective elongate slots (65, 77) connecting the inner chamber of the guide cylinder (5, 105) and the guide channel (71, 171) with each other.

7. A setting tool according to claim 1, wherein both the guide housing (7, 107) and the slide (73, 113) have a circular cross-section.

8. A setting tool according to claim 7, wherein the guide housing (7, 107) has an elongate channel (74) extending parallel to a longitudinal axis of the drive piston (6, 106), and a guide member (76) extending through the elongate channel (74) formed in the guide housing (7, 107).

9. A setting tool according to claim 7, wherein the guide member (76) is formed as a bolt connected with the slide (73, 173).

* * * * *